United States Patent [19]

Stahlecker et al.

[11] Patent Number: 4,628,685

[45] Date of Patent: Dec. 16, 1986

[54] YARN PIECING ARRANGEMENT FOR AN OPEN-END FRICTION SPINNING MACHINE

[75] Inventors: Fritz Stahlecker, Bad Uberkingen; Heinz Merkel, Gotthardt, both of Fed. Rep. of Germany

[73] Assignee: Fritz and Hans Stahlecker, Goppingen, Fed. Rep. of Germany

[21] Appl. No.: 714,920

[22] Filed: Mar. 22, 1985

[30] Foreign Application Priority Data

Mar. 22, 1984 [DE] Fed. Rep. of Germany ..... 3410471

[51] Int. Cl.[4] ..... D01H 15/02; D01H 1/135

[52] U.S. Cl. ..... 57/263; 57/261; 57/401; 57/405; 57/407

[58] Field of Search ..... 57/261, 263, 401, 400, 57/405, 407

[56] References Cited

U.S. PATENT DOCUMENTS

| | | | |
|---|---|---|---|
| 4,083,171 | 4/1978 | Konig et al. | 57/263 |
| 4,089,155 | 5/1978 | Stahlecker | 57/263 |
| 4,107,957 | 8/1978 | Stahlecker et al. | 57/263 |
| 4,120,140 | 10/1978 | Raasch et al. | 57/263 |
| 4,202,163 | 5/1980 | Turk et al. | 57/401 |
| 4,276,742 | 7/1981 | Raasch et al. | 57/263 |
| 4,327,546 | 5/1982 | Derichs et al. | 57/263 |
| 4,367,623 | 1/1983 | Parker et al. | 57/401 X |
| 4,380,892 | 4/1983 | Parker et al. | 57/401 |
| 4,471,606 | 9/1984 | Parker et al. | 57/401 X |

FOREIGN PATENT DOCUMENTS

| | | |
|---|---|---|
| 2011956 | 7/1979 | United Kingdom . |
| 2139652 | 11/1984 | United Kingdom . |
| 2142048 | 1/1985 | United Kingdom . |

*Primary Examiner*—John Petrakes

*Attorney, Agent, or Firm*—Barnes & Thornburg

[57] ABSTRACT

In the case of an open-end friction spinning machine having a plurality of spinning units that are arranged next to one another and having a movable servicing apparatus carrying out a piecing process, it is provided that approximately in the extension of the yarn formation zone facing away from the withdrawal device, a twist blocking device is provided for receiving a yarn end that is returned beyond the feeding point. The device for the yarn withdrawal is switched on when the yarn end is in the yarn formation zone of the friction elements so that the yarn end is opened up into a fiber-beard that is suitable for piecing while being held by the twist blocking device.

35 Claims, 5 Drawing Figures

YARN PIECING ARRANGEMENT FOR AN OPEN-END FRICTION SPINNING MACHINE

SUMMARY AND BACKGROUND OF INVENTION

This invention relates to an open-end friction spinning machine having a plurality of spinning units arranged next to one another. Each spinning unit contains two rollers that are arranged next to one another and are drivable in the same rotational direction to form a wedge-shaped gap serving as a yarn forming point or region. Each spinning unit also contains a feeding and opening device for the feeding of individual fibers via a fiber feeding duct to a feeding portion of the wedge-shaped gap, a withdrawal device for withdrawing the spun yarn in the longitudinal direction of the wedge-shaped gap, and a winding device for winding the spun yarn onto a spool. The spinning machine also has a movable servicing apparatus that can be applied to respective spinning units in need of servicing. This servicing apparatus is equipped with devices for receiving the broken yarn end from the spool, with devices for returning the yarn end into the spinning unit in need of servicing, with devices for controlling the feeding of fibers during the piecing process, with devices for withdrawing the pieced yarn, and with devices for winding the pieced yarn onto the spool.

In the case of an individual open-end friction spinning device, it is known from European Published Unexamined Application (EP-OS) No. 34 427 to manually carry out a piecing process. In this case, the winding spool is lifted off its operational drive, after which a spun yarn end is unwound and shortened to a predetermined length. The length of the yarn end is established in such a way that it reaches into the area of the yarn forming point, i.e. into the area of a fiber feeding duct opening in the direction of the wedge-shaped gap. The shortened yarn end must be held at a distance from the wedge-shaped gap in straight stretched condition. Then a suction device that had been switched off for the return of the yarn end is switched on again, this suction device normally affecting the area of the wedge-shaped gap. Almost simultaneously with the switching-on of this suction device, the fiber feeding must be started, after which the yarn withdrawal is resumed by placing the winding spool on its operational drive. The yarn that is led past the operational withdrawal device during the piecing must then be inserted into the withdrawal device. In the case of this piecing process, no high-quality yarn piecings can be obtained which with respect to their appearance and their stability properties correspond substantially to the spun yarn. One of the reasons for the poor quality piecings is that the position of the returned yarn end within the spinning unit is not really controlled. Another reason for the poor quality piecings is that the cut-off yarn end results in a thickened point when the newly fed fibers are deposited, which, in addition, does not have sufficient strength.

The invention is based on the objective of permitting a piecing process that can be carried out automatically, where the yarn end takes up a defined position within the spinning unit and where the yarn end exhibits a configuration that is suitable for piecing.

This objective is achieved according to the invention by providing a twist blocking means for receiving and holding the yarn end returned beyond the feeding point in the area facing away from the withdrawal device of the spinning unit, approximately as an extension of the wedge-shaped gap of the friction rollers, and by providing means for exposing the area of the yarn end located behind the twist blocking means in the yarn withdrawal direction to the frictional effect of the turning friction rollers.

Since the yarn end is returned into the twist blocking means and is held there, it takes up a defined position within the spinning unit according to preferred embodiments of the invention. Since the yarn end following the twist blocking means in the yarn withdrawl direction is subjected to the frictional effect of the turning rollers, it is untwisted in the area between the twist blocking means and the area of the rollers exercising the frictional effect and is freed of its spinning twist. In this area, the cutting or severing of the yarn end will then take place, resulting in a fiberbeard-type end that is suitable for piecing, at which end the fibers fed during the piecing process can deposit and tie up well so that a high-quality yarn piecing is obtained which with respect to strength and appearance is comparable to the remaining spun normally yarn. The severing of the yarn end will take place at a predetermined location in each instance, approximately a staple length of the fibers from the twist blocking means.

In an advantageous development of the invention, it is provided that the distance between the twist blocking means and the area in which the yarn end in the wedge-shaped gap of the rollers is exposed to the frictional effect is at least equal to, and preferably larger, than the fiber staple length. The result is that the cutting of the yarn end takes place without the separating of the individual fibers.

In a further development of certain preferred embodiments of the invention, it is provided that each spinning unit is equipped with a stationary twist blocking means, and that the servicing apparatus is equipped with means for actuating the twist blocking means.

In a further development of certain preferred embodiments of the invention, it is provided that the movable servicing apparatus is provided with a twist blocking means that can be applied to the spinning unit in need of servicing in the area facing away from the withdrawal device as an extension of the wedge-shaped gap of the rollers of the spinning unit. This development results in a simplification because of the fact that, on the one hand, the twist blocking means must exist only once, namely at the servicing apparatus, and on the other hand, the means for actuating and controlling the twist blocking means must also only exist once. It is advantageous in this case that the twist blocking means aligns itsef at a stop or similar device of the spinning unit so that precisely defined identical conditions exist at each spinning unit during the piecing.

In a further development of certain preferred embodiments of the invention, it is provided that the twist blocking means contains a suction pipe that is connected to a vacuum source. This makes is possible to return the yarn end into the twist blocking means with a sufficient length that does not have to be exactly defined. In addition, the part of the yarn end that is detached during the cutting can be transported in a simple manner out of the area of the spinning unit.

In a further development of certain preferred embodiments of the invention, a yarn clamp is provided as the twist blocking means. As compared to other possibilities of making a twist blocking means, this yarn clamp has the advantage that, irrespective of outside conditions, the same conditions always exist, and especially, that it is prevented that the yarn can shift in longitudinal direction so that the cutting takes place practically at the same point in all cases.

In a further development of the invention, it is provided that the twist blocking means is displaced in the direction away from the rollers with respect to the wedge-shaped gap. The result is that the cutting or severing of the yarn end takes place in an area that is not yet in contact with the shell or friction surfaces of the rollers. The separated yarn end that is opened up to form a fiberbeard reaches the area of the wedge-shaped gap only at the time of the withdrawal for the piecing process. Thus it is prevented that the end twisted open to form a fiberbeard is twisted together before the actual piecing process.

In a further development of certain preferred embodiments of the invention, it is provided that the servicing apparatus is equipped with means for interrupting and switching-on the operational drive of the rollers of the spinning unit to be serviced, and with an auxiliary drive that can be applied to the rollers. In a further development of certain preferred embodiments of the invention, it is provided that each spinning unit is equipped with a suction device acting in the area of the wedge-shaped gap, and that the servicing apparatus is equipped with means for controlling the effect of the suction device of the spinning unit to be serviced. As a result it is possible to control all devices required for the piecing process directly from the servicing apparatus so that exactly the same conditions can be created for each piecing process.

In a further development of certain preferred embodiments of the invention it is provided that the devices for the rewithdrawal of the pieced yarn, the devices for the winding of the yarn, the devices for controlling the feeding of the fibers and the auxiliary drive for the rollers contain driving motors with controllable speed and are connected to a control circuit controlling the coordination of the speeds with respect to one another. As a result, it is possible to directly coordinate and proportion the individual work steps in a piecing process with respect to one another. In addition, it is possible to let the piecing process take place at reduced speeds which are adjustable in such a way that during the piecing a yarn count is spun that corresponds to the operationally spun yarn count. It is also possible after the piecing to increase the speeds to the operational speeds in such a way that also during this time the desired yarn count is spun. This is advantageous because of the high delivery speeds of the spinning units of an open-end friction spinning machine because already during the piecing and the increasing to operational speeds, relatively large quantities of yarn are produced which reach the spool to be furether processed. Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
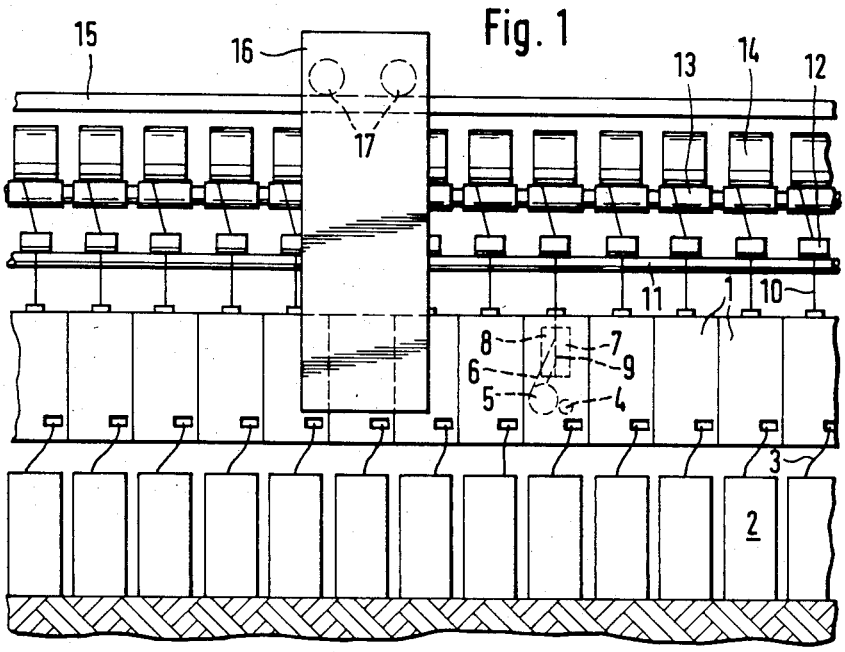
FIG. 1 is a front schematic view of a part of an open-end friction spinning machine having a plurality of individual spinning units and a movable servicing apparatus that can be applied to the spinning units constructed in accordance with a preferred embodiment of the invention.

The open-end friction spinning machine according to FIG. 1 has a plurality of spinning units 1 arranged next to one another in a row that are similar with respect to one another. A sliver 3 is fed to each spinning unit 1 from a can 2, said sliver 3 being pulled in by a feeding roller 4 and being offered to a rapidly turning opening roller 5, which roller 5 opens the sliver 3 up into individual fibers, The individual fibers move via a fiber feeding duct 6 from the opening roller 5 to the area of a wedge-shaped gap 9 formed by two friction rollers 7 and 8 that are arranged next to one another and are drivable in the same rotational direction.

The yarn 10 twisted together in the wedge-shaped gap 9 of the rollers 7 and 8 is withdrawn by means of a withdrawal device in the longitudinal direction of the wedge-shaped gap 9, said withdrawal device including a driven bottom cylinder 11 and one pressure roller 12 for each spinning unit 1. Each spinning unit 1 is provided with a grooved drum 13 arranged on a shaft running through in the longitudinal direction of the machine and in each case driving one winding spool 14 onto which the spun yard 10 is wound.

The open-end friction spinning machine is provided with rails 15 on which a servicing apparatus 16 can be moved by means of running wheels 17 of which at least one is driven. For carrying out servicing operations, the servicing apparatus 16 can be selectively applied to respective spinning unit 1. Each spinning unit 1 is provided with a signal transmitter indicating the need for servicing to which a corresponding signal receiver of the servicing apparatus 16 is assigned according to certain contemplated embodiments of the invention. Among other things, the servicing apparatus 16 may carry out the exchange of winding spools 14 for empty ones and/or the cleaning of the spinning units 1 and especially of the rollers 7 and 8. The servicing apparatus 16 is designed in particular for carrying out a piecing process according to the present invention. For this reason, and in order not to obscure the present invention, only the functional elements of the servicing apparatus 16 are explained below that are required for the piecing process.

A flow of suction air is generated within the friction rollers 7 and 8 (FIGS. 2 and 3) that are arranged in parallel closely next to one another. This suction air flow enters the inside of the rollers 7 and 8 in the area of the yarn forming wedge-shaped gap 9, the rollers 7 and 8 being each provided with a perforated shell surface for this purpose. According to other contemplated embodiments, it is sufficient to perforate only the shell surface of the roller 7 rotating into the fiber-guiding wedge-shaped gap 9, while the other roller 8 will then have a closed shell surface and is preferably provided with fittings consisting of a material causing a predetermined frictional effect.

A suction pipe 20, 21 is housed on the inside of each roller 7 and 8, said suction pipes 20 and 21 in each case being aimed against the area of the wedge-shaped gap 9 by means of respective suction slots 22 and 23 delimited by surrounding webs projecting up to close to the inside surfaces of the respective rollers 7 and 8. The rollers 7 and 8, which are formed as cylindrical sleeves, are disposed directly on the suction pipes 20 and 21 by means of roller bearings 28. At least on one side, the suction pipes 20 and 21 are extended beyond the end faces of the rollers 7 and 8 and are clamped tight in bowl-shaped recesses of a bearing housing 29 by means of bearing holders 30 also having bowl-shaped recesses. The suction pipes 20 and 21 that are closed on the front side are connected to a suction pipeline 36 via vacuum ducts 34 by means of a valve 35, this suction pipeline 36 being connected to a vacuum source in a way that is not shown in detail.

The bearing holders 29 are fastened on a part 31 of the machine frame. The part 31 and the bearing housings 29 exhibit a recess or opening 32 in which a tangential belt 24 runs against the shell surfaces of the rollers 7 and 8. Belt 24 runs through the whole open-end friction spinning machine in the direction of the arrow 25 and drives the rollers 7 and 8 of all spinning units 1. On the side that is opposite the wedge-shaped gap 9, one pressure roller 33 is arranged for each spinning unit which presses the tangential belt 24 against the shell surfaces of both rollers 7 and 8 at that unit. The tension roller 33 is disposed on a holder 62 that can be pivoted around an axis extending in parallel to the shafts of the rollers 7 and 8 and that is loaded by means of a spring 63 in the direction of the rollers 7 and 8.

The suction air flow generated in the suction pipes 20 and 21 and in the area of the wedge-shaped gap 9 aimed into the inside of the rollers 7 and 8 has the purpose of holding the forming yarn 10 and the fibers securely in the wedge-shaped gap 9 and also at least supporting the transport of the fibers in the fiber feeding duct 6. The fiber feeding duct 6 connects the opening roller 5 displaced below and in the direction of the operating side of the open-end friction spinning machine in a straight line with the wedge-shaped gap 9. The fiber feeding duct 6 starts approximately tangentially at the opening roller 5 and is slot-shaped and leads out by means of a slot-shaped mouth 19 extending in the longitudinal direction of the wedge-shaped gap 9, the mouth 19 representing a fiber feeding point or a fiber feeding area. The fiber feeding duct 6 is subdivided in its longitudinal direction. The first segment 38 is located in a stationary opening roller housing 37. The second segment 39, forming the fiber feeding duct 6 reaching to the mouth 19, is a component of a partial housing 18 that can be pivoted around a pivotal shaft 40 located below the feeding roller 4 and the opening roller 5. The area of the wedge-shaped gap 9 can be exposed by a swivelling-away of the partial housing 18.

The feeding roller 4, in a manner that is not shown in detail, is driven by a shaft running through in the longitudinal direction of the machine via a pinion gear. An electric switch coupling is arranged between the feeding roller 4 and the toothed-wheel gear in a manner that is not shown in detail, the switch coupling being controlled by a yarn guard 50 which monitors the presence of a yarn between the rollers 7 and 8 and the withdrawal device 11, 12 by means of a sensor 49. In the case of a yarn breakage, the yarn guard 50 stops the feeding roller 4 by the opening of the coupling so that a further feeding of fibers is interrupted.

In a manner that is not shown in detail, the opening roller 5 is provided with a wharve protruding from its housing 37, said wharve being driven by means of a tangential belt running through in the longitudinal direction of the machine, said tangential belt driving all opening rollers 1 of the spinning units 1 of one side of the machine.

In the case of the shown embodiment of an open-end friction spinning machine, in the case of a yarn breakage only the drive of the feeding roller 4 is interrupted via the coupling, while all other driven elements continue to run, such as the opening roller 5, the rollers 7 and 8, the withdrawal device 11, 12 and the grooved drum 13. The vacuum in the suction pipes 20 and 21 is also maintained. The following statemens concerning the piecing process apply mainly to this embodiment. These same statements are also valid when, as a modification, the open-end friction spinning machine is developed in such a way that in the case of a yarn breakage not only the feeding roller 4, but especially also the rollers 7 and 8 are stopped and the vacuum is interrupted by the switching of the valve 35.

Figure 3:
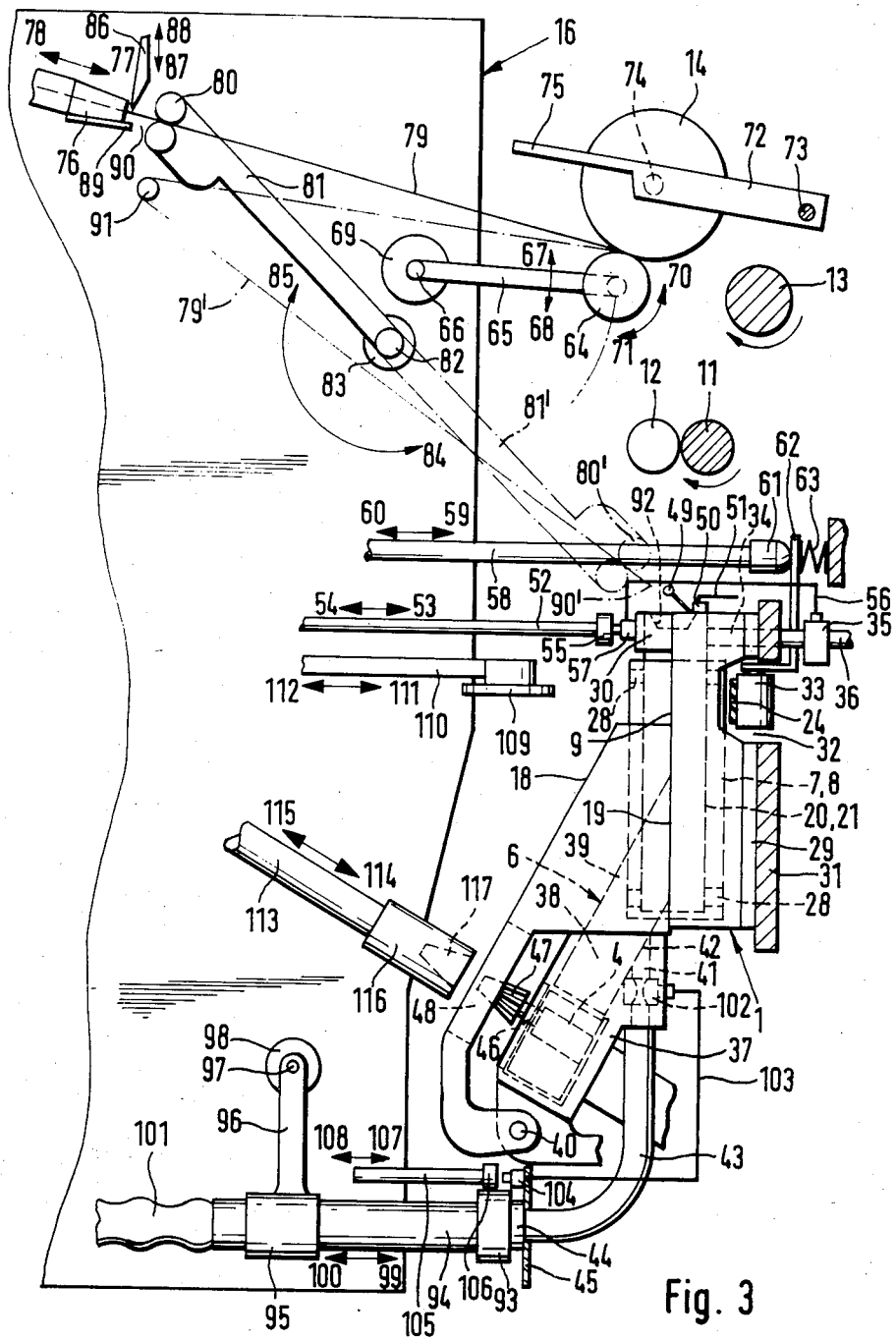
FIG. 3 is a vertical sectional schematic view through the open-end friction spinning machine of FIG. 1 showing a lateral view of a spinning unit and a partial view of the servicing apparatus operating at this spinning unit.

In the case of the spinning unit 1 shown in FIG. 3, a yarn breakage has occured so that the yarn guard 50 has stopped the feeding roller 4. The continued fiber feeding is therefore interrupted. At the same time, a signal was transmitted calling the servicing apparatus 16 to this spinning unit 1 in need of servicing. The servicing apparatus 16, independently from the drives of the machine side, carries out a piecing process, after the conclusion of which, the moving yarn is transferred to the spinning unit 1.

The servicing apparatus 16 is provided with a lift-off roller 64 by means of which the winding spool 14 is lifted off the continuously turning grooved roller 13. With its spool sleeve 74, the winding spool 14 is disposed in a spool frame 72 that can be pivoted around a shaft 73 fixed at the machine. The lift-off roller 64, which is drivable in both rotational direction corresponding to the arrows 70 and 71, is disposed on an arm 65 that can be pivoted in the direction of the arrows 67 and 68 by means of a motor operator 69 around a shaft 66 of the servicing apparatus 16. A suction nozzle 76 that can be moved in the direction of the arrows 77 and 78 is applied to the lifted-off winding spool 14, the suction nozzle 76 searching for the broken yarn end 79 at the winding spool 14 and then moving back into the shown position. In this case the winding spool 14 is driven in the winding direction by means of the driving of the lift-off roller 64 in the direction of the arrow 70. A pair of auxiliary rollers 80 is applied to the yarn end 79 held between the winding spool 14 and the suction nozzle 76, the pair of auxiliary rollers 80 also being drivable in both rotational directions. The yarn end 79 is then cut to an end 90 by means of a cutting device 86 that can be applied in the direction of the arrows 87 and 88 and to which a counter part 89 at the suction nozzle 76 is assigned.

Subsequently, the pair of auxiliary rollers 80 that are arranged on a pivotal arm 81 and can be pivoted around a shaft 82 by means of a motor operator 83 is swivelled into the dash-dotted position 80', 81'. In this case the broken yarn end 79, while a sufficient length is delivered by means of the drive of the lift-off roller 64, is placed around a yarn guide 91 in the direction of the arrow 70 and is brought into the dash-dotted position 79' and in which the end 90' is guided to an inlet funnel 92 in the area of the roller housing 29. In the meaintime, a pressure rod 58 was moved out from the servicing apparatus 16 in the direction of the arrow 59, which by means of a pressure piece 61 rests against the holder 62 of the tension roller 33 and presses it against the effect of the spring 63 in the direction away from the rollers 7 and 8. The tangential belt 24 guided by the corresponding deflection pulleys, together with the pressure roller 33 moves away from the rollers 7 and 8 so that the drive is interrupted. Also, a pressure rod 52 is moved in the direction of the arrow 53 out of the servicing apparatus 16. By means of a pressure piece 55, rod 52 actuates a switch 57 which is connected via a line 56 to the preferably electromagnetic valve 35 and which thus interrupts the vacuum in the area of the suction pipes 20 and 21.

From the servicing apparatus 16, a suction pipe line 94 was also applied with a connection piece 93 in the direction of the arrow 99 to a connection 44 of a suction pipe 43 of the spinning unit 1 arranged in the covering 45 of the machine. The suction pipe 43 is connected to a duct 41 which, by means of a mouth 42, leads out into the fiber feeding duct 6. The suction pipe line 94 is held in a holder 96 provided with a connection 95 to a flexible vacuum pipe connected to a vacuum source. Holder 96, by means of a motor operator 98, is pivotable around a stationary shaft 97 of the servicing apparatus 16. Advantageously, the connection 44 is developed in such a way that it contains a closing element that is opened by the application of the connection 93 of the servicing apparatus 16.

A yarn clamp 102 that can be actuated electromagnetically is located in the suction duct 41. Yarn clamp 102 is connected via a line 103 with a switch 104, which is accessible from the direction of the operating side of the spinning unit 1 to a pressure rod 105 of the servicing apparatus 16. Pressure rod 105 is able to be shifted in the direction of the arrows 107 and 108 and is operable to actuate the switch 104 by means of a pressure piece 106. By means of the connection of the vacuum source with the suction pipe 43 and the suction duct 41, a suction air flow is generated in the area of the wedge-shaped gap 9 aimed against the withdrawal direction, by means of which the yarn end 79 is sucked into the spinning unit 1. At the same time as the yarn is sucked into the unit the lift-off roller 64 is driven in the return direction (arrow 70) and the pair 80 of auxiliary rollers in position 80' is also driven in return direction. The yarn clamp 102 is closed after the yarn end 79 has been returned sufficiently far so that it reaches into the area of the suction pipe 43.

An auxiliary drive of the servicing apparatus 16 is also applied to the rollers 7 and 8. This auxiliary drive includes a driving disk 109 which can be moved out on a rod 110 in the direction of the arrows 111 and 112 and which rests against the shell surfaces of both rollers 7 and 8 when it is moved out. The rollers 7 and 8 are driven during the piecing via this driving disk 109. The feeding roller 4 is extended to the outside by means of a shaft 46, this shaft 46 carrying a bevel wheel 47 located in the area of a recess 48 of the housing part 18. A coupling piece 116 of an auxiliary drive shaft 113 is provided with a corresponding recess 117 and is applied to this bevel wheel 47 in the direction of the arrow 114. The fiber feeding during the piecing process is controlled via this auxiliary drive shaft 113 by means of the driving of the feeding roller 4.

For carrying out the actual piecing process, the suction air flow is again produced in the area of the wedge-shaped gap 9 by at least partially opening the valve 35 so that the returned yarn end is sucked into the wedge-shaped gap 9.

In addition, the auxiliary drive, i.e., the driving disk 109 resting against the rollers 7 and 8, is switched on. In this manner the yarn end 79 is subjected to the roller frictional effect in the area in which it is located in the wedge-shaped gap 9. This means that the yarn end 79, in the area between the yarn clamp 102 and the area subjected to the frictional effect, is twisted open against the spinning direction. The switching-on of the suction effect of the suction pipes 20 and 21 and the driving of the rollers 7 and 8 takes place in a coordinated manner so that the point in time can be predetermined precisely at which the spinning twist in the yarn is completely undone. This point in time is preferably monitored by a tension sensor arranged in the area between the auxiliary rollers 80 (when in position 80') and the rollers 7 and 8. When the yarn is twisted open, the auxiliary rollers 80 are switched on in the yarn withdrawal direction so that the yarn end 79 is severed in the area between the still closed yarn clamp 102 and the mouth 19 of the fiber feeding duct 6. In this case, a fiberbeard-type opened up end is formed at the yarn end 79. This opened-up end then reaches the wedge-shaped gap 9 via the remainder of the fiber feeding duct 6. In time with the time-related coordination of this sequence, the feeding roller 4 is driven via the shaft 113 so that the transport of the fibers to the wedge-shaped gap 9 starts in a manner that fibers are present in the wedge-shaped gap 9 which are tied into the opened-up end when it reaches the area of the feeding point adjacent mouth 19. With the switching-on of the auxiliary rollers 80 (position 80'), the lift-off roller 64 is also switched in the winding direction (direction of the arrow 71) so that the pieced yarn is wound onto the winding spool 14.

The individual elements of the servicing apparatus, i.e., the shaft 113, the driving disk 109, the auxiliary rollers 80 and the lift-off roller 64 are provided with adjustable driving motors, the speeds of which can be coordinated to one another in such a way that already during the piecing, a yarn of the same yarn count is spun that is also spun under normal operational conditions. Controlled by means of a programmed control system, these driving motors are then accelerated to the operational values after which the operational drives will be used again. The pressure rod 58 is moved back in the direction of the arrow 60 so that the tangential belt 24 is again applied to the rollers 7 and 8. The rod 110 is moved back in the direction of the arrow 112 so that the driving disk 109 is disengaged from the rollers 7 and 8. The lift-off roller 64 is pivoted away in the direction of the arrow 68 so that the winding spool 14 is applied to the grooved drum 13. The yarn guide 91 or the auxiliary yarn guide are moved in such a way that the moving yarn is again transferred to the withdrawal device 11, 12, while the auxiliary rollers 80 are disengaged from the moving yarn. In addition, the shaft 113 is withdrawn as soon as the moving yarn reaches its operational position and has brought the yarn sensor 49 of the yarn guard 50 into the operating position, and therefore the coupling of the feeding roller 4 is closed and the operational drive of the feeding roller 4 is switched on.

After the yarn end 79 is severed in the area between the yarn clamp 102 and the rollers 7 and 8, the yarn clamp 102 is opened so that the yarn piece located in the suction pipe 43 is sucked off. Immediately after that, the suction air flow in the suction pipe 43 is interrupted so that the fiber transport to the wedge-shaped gap 9 is not disturbed.

As a modification of the embodiment according to FIG. 3, it is also contemplated to develop the suction pipe 43 with the suction duct 41 and the yarn clamp 102 also as a component of the servicing apparatus 16 which is then formed preferably in one piece with the suction pipeline 94 and is applied to the corresponding spinning unit 1 by means of the pivoting of the holder 96. In this case, the suction duct 41 is advantageously arranged approximately as a direct extension of the wedge-shaped gap 9, in which case the application takes place in such a way that the suction duct 41 rests against a stop of the spinning unit 1. In this case, it is advantageous that the area of the rollers 7 and 8 located between the mouth 19 of the fiber feeding duct 6 and the suction duct 41 has a reduced frictional effect which, for example, can be achieved by the fact that the perforation does not exist and/or that there the width of the wedge-shaped gap 9 is larger.

Figure 4:
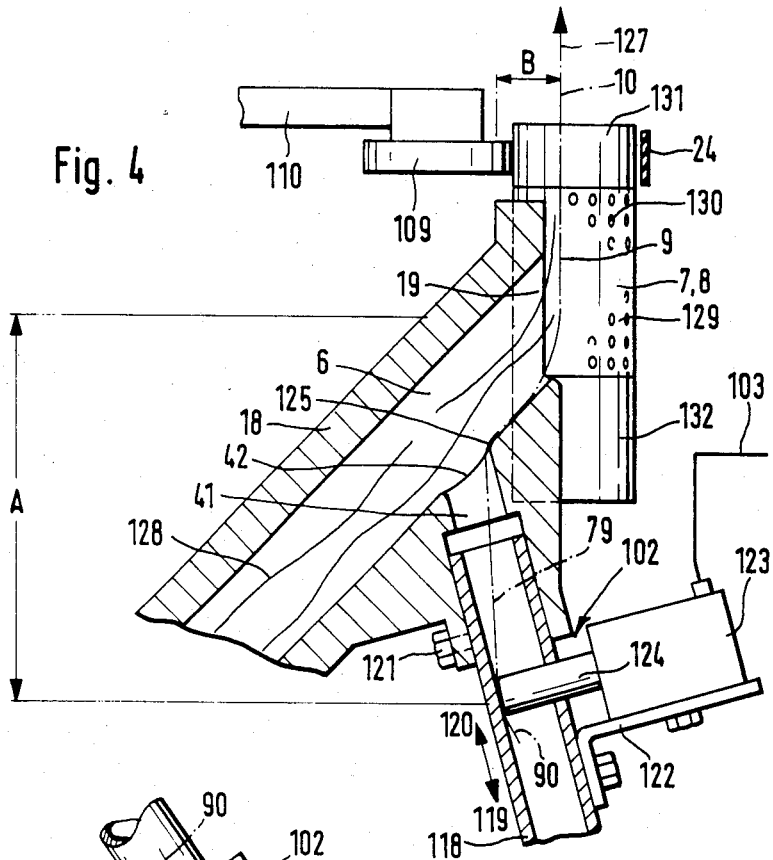
FIG. 4 is a vertical sectional schematic view through a detail of a spinning unit of FIGS. 1-3 in the area of the fiber feeding device.

In FIG. 4, a detail of FIG. 3 is shown in a larger scale. The yarn end 79 was sucked back into the area behind the yarn clamp 102 (below clamp 102 in FIG. 3). The tangential belt 24 is lifted off the driving area 131 of the rollers 7 and 8 that is not provided with a perforation, while the driving disk 109 is applied to this area. The yarn clamp 102 is closed. Yarn clamp 102 includes an electromagnet 123 arranged on a holder 122, which electromagnet 123 has a piston 124 that can be moved out by means of which the yarn end 79, at a distance to its extreme free end 90, is clamped tightly in a sleeve 118 forming the suction duct 41. By the switching-on of the suction devices of the rollers 7 and 8 and by the driving of the rollers 7 and 8 by means of the driving disk 109 the yarn end 79 receives a twist which is directed against the spinning twist contained in it in the area located between the mouth of the fiber feeding duct 19 and the yarn clamp 102. As a result, the yarn end 79 is twisted open in this area so that it loses its firmness. As soon as the right predetermined opening condition of the yarn end 79 is reached, the pair of auxiliary rollers 80 (together with the lift-off roller 64) is driven in the withdrawal direction of the yarn so that a pulling force is created by means of which the yarn end 79 is severed in the opened up area at a predetermined location with respect to the yarn clamp 102 and the opening of the fiber feeding duct. Thus, a fiberbeard type end is formed that has an especially suitable condition for being spun with the newly fed fibers 128.

As shown in FIG. 4, the suction duct 41, in the proximity of the mouth 19 of the fiber feeding duct 6, is connected to this fiber feeding duct 6 so that the returned yarn end 79 is lifted out of the wedge-shaped gap 9 and moves via a deflecting guide 125. The end of the yarn end 79 that was separated and opened up by untwisting therefore is not immediately located in the wedge-shaped gap, so that it does not reach this wedge-shaped gap 9 before a further withdrawal and is not twisted together prematurely.

As shown in FIG. 4, the yarn clamp 102 is arranged at a distance A from the feeding point (mouth 19) which is at least identical to the staple length of the fiber material and is preferably kept a little larger. This prevents that during the cutting individual fibers are torn. The distance A can be adjusted by the fact that the sleeve 118, together with elecromagnets 123 fastened at it, can be axially shifted in the suction duct 41 in the direction of the Arrows 119 and 120 and can be fixed in the desired position by means of a locking screw 121.

Figure 2:
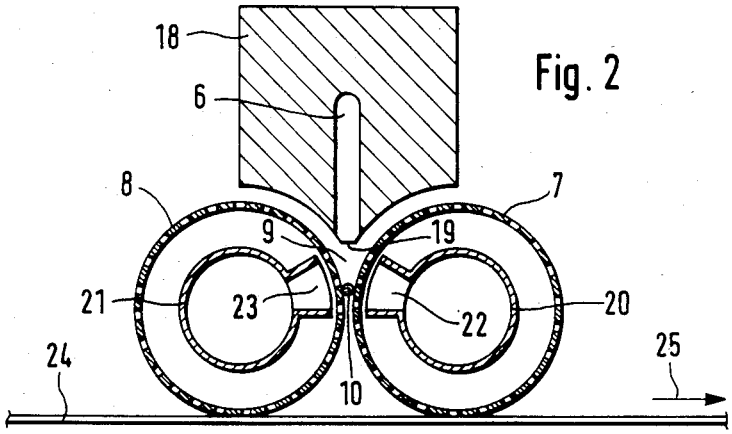
FIG. 2 is an enlarged horizontal sectional schematic view of an individual spinning unit of the spinning machine of FIG. 1.
Figure 5:
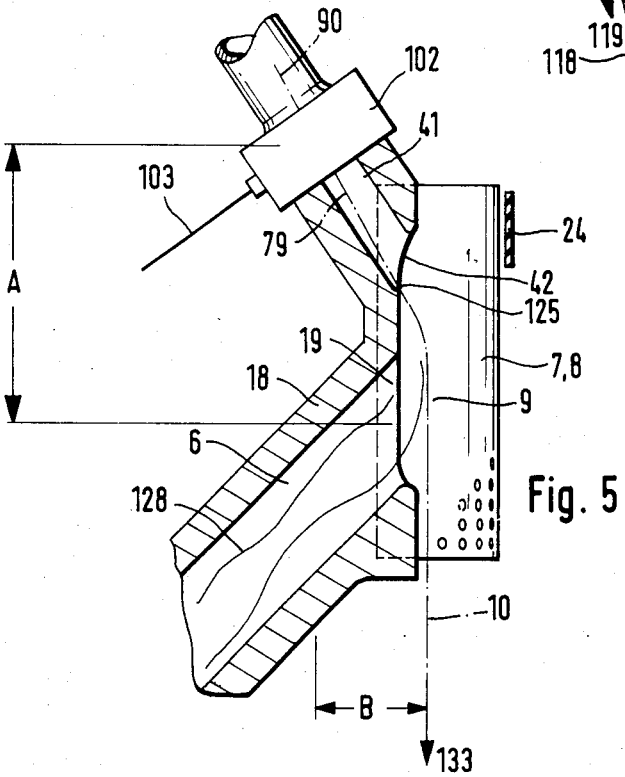
FIG. 5 is a partial sectional view similar to FIG. 4 through another embodiment of the invention.

In the case of the embodiment according to FIG. 4, the withdrawal of the yarn 10 takes place in the direction of the arrow 127, as in the case of the embodiment according to FIGS. 1 to 3, essentially in the direction of the fed fibers 128 which are fed in the fiber feeding duct 6 extending at an acute angle with respect to the wedge-shaped gap 9. In the case of the embodiment according to FIG. 5, on the other hand, the principle of the so-called "backward spinning" is used, i.e., the withdrawal of the yarn 10 takes place in the direction of the arrow 133, essentially against the feeding direction of the fibers 128 fed in the fiber feeding duct 6 aimed at an acute angle with respect to the wedge-shaped gap 9. The suction duct 41, in the case of the embodiment according to FIG. 5, is provided against the withdrawal direction 133 following the mouth 19 of the fiber feeding duct 6 and is aimed slightly diagonally from the wedge-shaped gap 9 to the outside. In a corresponding manner, as in the case of the other embodiments, in this case also, the suction duct 41 is provided with a yarn clamp 102 at a distance A from the feeding point. In the case of this embodiment, it is advantageous not to perforate the rollers 7 and 8 in the area of the mouth 42 of the suction duct 41 and/or to provide in this area a wedge-shaped gap 9 that is slightly wider so that in this area, the frictional effect is reduced.

It should be understood that in the specification and claims, the term "broken yarn end" (79) includes yarn ends for starting new spools as well as piecing with a broken end on a partially filled spool.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open-end friction spinning machine having at least one spinning unit comprising:

friction surface means for forming a yarn formation zone;

fiber supply means for supplying fibers to the yarn formation zone, said fiber supply means including fiber feed channel mouth means adjacent the friction surface means;

yarn withdrawing means for withdrawing formed yarn from the yarn formation zone;

yarn winding device means for winding the spun yarn onto a spool;

yarn end receiving and returning means for receiving a broken yarn end from the spool and returning same into the spinning unit for piecing with fibers fed by the fiber supply means;

piecing control means for controlling the feeding of fibers by the fiber supply means during piecing and for controlling the withdrawing of pieced yarn and winding the same onto the spool;

twist blocking means for receiving and holding the broken yarn end at a position located outside the region of the fiber feed channel mouth means, said position being displaced from the mouth means in a direction opposite the normal spinning withdrawal direction; and friction effect means for subjecting an area of the broken yarn end located at the normal yarn withdrawal direction side of the twist blocking means to frictional effects of the surfaces of the friction surface means.

2. An open-end friction spinning machine according to claim 1, wherein said friction means comprises at least two friction rollers disposed adjacent one another and said yarn formation zone comprises a wedge-shaped gap formed by said at least two friction rollers.

3. An open-end friction spinning machine according to claim 2, wherein said friction means comprises a pair of friction rollers disposed adjacent one another.

4. An open-end friction spinning machine according to claim 1, wherein the distance of the twist blocking means from the area in the yarn formation zone of the friction means in which the broken yarn end is subjected to the frictional effect is larger than the staple length of the fiber material being spun.

5. An open-end friction spinning machine according to claim 1, comprising a plurality of said spinning units arranged adjacent one another at a machine frame, wherein a drivable servicing apparatus is provided which is selectively movable to servicing positions at respective spinning units to carry out yarn piecing operations.

6. An open-end friction spinning machine according to claim 5, wherein the distance of the twist blocking means from the area in the yarn formation zone of the friction means in which the broken yarn end is subjected to the frictional effect is larger than the staple length of the fiber material being spun.

7. An open-end friction spinning machine according to claim 5, wherein each spinning unit is provided with a stationary twist blocking means, and the servicing apparatus is equipped with means for actuating the twist blocking means.

8. An open-end friction spinning machine according to claim 5, wherein the drivable servicing apparatus is provided with a twist blocking means that can be applied to the spinning unit in need of servicing in the area facing away from the yarn withdrawal means of the spinning unit, as an extension of the yarn formation zone of the friction means of the spinning unit.

9. An open-end friction spinning machine according to claim 5, including exposing means for selectively exposing the yarn formation zone of the individual spinning units for the purpose of accomodating the return of the broken yarn end, said exposing means being carried on the servicing apparatus.

10. An open-end friction spinning machine according to claim 5, wherein the twist blocking means contains a suction pipe that is connected to a vacuum source.

11. An open-end friction spinning machine according to claim 10, wherein the connection of the suction pipe to its vacuum source can be controlled by means of the servicing apparatus.

12. An open-end friction spinning machine according to claim 5, wherein a yarn clamp is provided as the twist blocking means.

13. An open-end friction spinning machine according to claim 12, wherein the servicing apparatus is equipped with means for actuating the yarn clamp.

14. An open-end friction spinning machine according to claim 5, wherein the twist blocking means is displaced with respect to the yarn formation zone in the direction away from the friction means.

15. An open-end friction spinning machine according to claim 5, wherein the fiber supply means includes fiber feed channel means and wherein a suction pipe with the twist blocking means is connected to the fiber feed channel means of the fiber supply means at a short distance in front of the fiber feed channel mouth means.

16. An open-end friction spinning machine according to claim 5, wherein means are provided for applying the broken yarn end to the yarn formation zone between the twist blocking means and the fiber feed channel mouth means, and wherein in the area between the twist blocking means and the fiber feed channel opening means the frictional effect of the friction surface means is reduced as compared to the remaining area.

17. An open-end friction spinning machine according to claim 5, wherein the servicing apparatus is equipped with means for interrupting the operational drive of the friction means of the spinning unit to be serviced and with an auxiliary drive that can be applied to the friction surface means.

18. An open-end friction spinning machine according to claim 5, wherein each spinning unit is provided with a suction device acting in the area of the yarn formation zone, and wherein the servicing apparatus is equipped with means for controlling the effect of the suction device of the spinning unit to be serviced.

19. An open-end friction spinning machine according to claim 1, wherein the twist blocking means contains a suction pipe that is connected to a vacuum source.

20. An open-end friction spinning machine according to claim 19, wherein the suction pipe of the twist blocking means has an orientation relative to the fiber supply means such that a sucked-in yarn end is deflected about 90°.

21. An open-end friction spinning machine according to claim 1, wherein a yarn clamp is provided as the twist blocking means.

22. An open-end friction spinning machine according to claim 1, wherein the twist blocking means is displaced with respect to the yarn formation zone in the direction away from the friction surface means.

23. An open-end friction spinning machine according to claim 1, wherein a suction pipe with the twist blocking means is connected to the fiber feeding means of the fiber supply means at a short distance in front of the fiber feed channel mouth means.

24. An open-end friction spinning machine according to claim 23, wherein means are provided for applying the broken yarn end to the yarn formation zone between the twist blocking means and the fiber feed channel mouth means, and wherein in the area between the twist blocking means and the fiber feed channel opening means the frictional effect of the friction surface means is reduced as compared to the remaining area.

25. An open-end friction spinning machine according to claim 1, wherein means are provided for applying the broken yarn end to the yarn formation zone between the twist blocking means and the fiber feed channel mouth means, and wherein in the area between the twist blocking means and the fiber feed channel mouth means the frictional effect of the friction surface means is reduced as compared to the remaining area.

26. An open-end friction spinning machine according to claim 1, wherein the piecing control means includes time coordinating means for coordinating switching-on of the fiber supply means with operation of the device for withdrawing the yarn to be pieced, said time coordinating means causing fed fibers to reach the area of the fiber feed channel mouth means simultaneously with or shortly before the yarn end reaches said area.

27. An open-end friction spinning machine according to claim 1, wherein devices for the rewithdrawal of the pieced yarn, devices for the winding of the yarn, devices for the control of the feeding of the fibers, and auxiliary drive means for the friction means contain driving motors that can be adjusted in their speeds and are connected to a control switching circuit of the piecing control means for controlling the yarn speeds with respect to one another.

28. An open-end friction spinning machine according to claim 27, wherein the speeds during the piecing are coordinated with values that are reduced as compared to the operational speeds in such a way that during the piecing the same yarn count is spun that is spun under operational conditions.

29. A method of piecing a yarn on a spinning machine of the type having at least one spinning unit comprising:

friction surface means for forming a yarn formation zone;

fiber supply means for supplying fibers to the yarn formation zone, said fiber supply means including fiber feed channel mouth means opening adjacent surface portions of the friction surface means;

yarn withdrawing means for withdrawing formed yarn from the yarn formation zone;

yarn winding device means for winding the spun yarn onto a spool;

yarn end receiving and returning means for receiving a broken yarn end from the spool and returning same into the spinning unit for piecing with fibers fed by the fiber supply means; and piecing control means for controlling the feeding of fibers by the fiber supply means during piecing and for controlling the withdrawing of pieced yarn and winding the same onto the spool;

said method comprising the sequential steps of: returning a broken yarn end from the spool into the spinning unit to a position outside the region of the yarn formation zone, said position being displaced from the yarn formation zone in a direction opposite the normal spinning withdrawal direction;

holding the returned broken yarn end with twist blocking means at a position located outside the region of the fiber feed channel mouth means, said position being displaced from the mouth means in a direction opposite the normal spinning withdrawal direction, and applying the area of the broken yarn end located at the normal yarn withdrawal direction side of the twist blocking means against the friction outer circumferential surfaces of the friction means to thereby prepare a predetermined fiber beard in the broken yarn end which is suitable for piecing.

30. A method according to claim 29, wherein said friction surface means comprises at least two friction rollers disposed adjacent one another and said yarn formation zone comprises a wedge-shaped gap formed by said at least two friction rollers.

31. A method according to claim 30, wherein said friction surface means comprises a pair of friction rollers disposed adjacent one another.

32. A method of piecing a yarn on a spinning machine according to claim 29, wherein said applying of the area of the broken yarn end to the friction surface means is done in such a manner as to result in severance of the broken end at a predetermined distance from the twist blocking means.

33. A method of piecing a yarn on a spinning machine according to claim 32, wherein said predetermined distance is approximately the length of the staple of fiber being spun.

34. A method of piecing a yarn on a spinning machine according to claim 29, wherein the twist blocking means is located at least one fiber staple length away from the fiber feed channel mouth means.

35. A method of piecing a yarn on a spinning machine according to claim 29, wherein the twist blocking means is movably adjustable to accommodate different staple fiber lengths.

* * * * *